US007073813B2

(12) United States Patent
Martin et al.

(10) Patent No.: US 7,073,813 B2
(45) Date of Patent: Jul. 11, 2006

(54) ATHLETIC BOOT WITH INTERFACE ADJUSTMENT MECHANISM

(75) Inventors: John D. Martin, Vashon, WA (US); William B. Hall, Seattle, WA (US)

(73) Assignee: K2 Corporation, Vashon, WA (US)

( * ) Notice: Subject to any disclaimer, the term of this patent is extended or adjusted under 35 U.S.C. 154(b) by 220 days.

(21) Appl. No.: 09/766,549

(22) Filed: Jan. 18, 2001

(65) Prior Publication Data

US 2002/0093175 A1 Jul. 18, 2002

(51) Int. Cl.
*A63C 9/20* (2006.01)
*A43B 5/04* (2006.01)

(52) U.S. Cl. ..... 280/613; 280/625; 280/636; 36/117.3

(58) Field of Classification Search ..... 36/117.3, 36/67 A, 67 D, 134, 131; 280/11.14, 613, 280/623, 634, 636, 14.21, 14.22, 617, 607, 280/633, 625, 11.12, 7.13, 11.3, 11.31, 11.32
See application file for complete search history.

(56) References Cited

U.S. PATENT DOCUMENTS 1,097,875 A * 5/1914 Pierce ..... 280/11.12
1,830,058 A * 11/1931 Helmond ..... 248/20
2,597,800 A * 5/1952 Hussman ..... 248/20
3,156,988 A * 11/1964 Rause ..... 36/81
4,712,318 A * 12/1987 Greiner et al. ..... 36/134
4,741,550 A * 5/1988 Dennis ..... 280/618
5,207,445 A * 5/1993 Hoelzl ..... 280/607
5,257,793 A * 11/1993 Fortin ..... 280/7.13
5,367,793 A * 11/1994 Deacon et al. ..... 36/67 A
5,503,900 A * 4/1996 Fletcher ..... 280/14.21
5,704,139 A * 1/1998 Okajima ..... 36/115
5,727,429 A * 3/1998 Ueda ..... 74/594.6
5,822,890 A * 10/1998 Beitel et al. ..... 36/134
5,845,421 A * 12/1998 Tanaka ..... 36/115
5,850,702 A * 12/1998 Okajima ..... 36/115
5,909,894 A * 6/1999 Meader et al. ..... 280/623
5,918,386 A * 7/1999 Marmonier ..... 36/117.3
6,062,586 A * 5/2000 Korman ..... 280/613
6,099,018 A * 8/2000 Maravetz et al. ..... 280/624
6,168,173 B1 * 1/2001 Reuss et al. ..... 280/14.2
6,286,855 B1 * 9/2001 Paris ..... 280/611
6,296,258 B1 * 10/2001 Higgins et al. ..... 280/14.22
6,328,328 B1 * 12/2001 Finiel ..... 280/636
2002/0089129 A1 * 7/2002 Aiken ..... 280/11.14

* cited by examiner

*Primary Examiner*—Jeff Restifo
(74) *Attorney, Agent, or Firm*—Christensen O'Connor Johnson Kindness PLLC

(57) ABSTRACT

An interface adjustment mechanism 100 includes a frame member 102 and fore and aft adjustable spacer holding members 104, 106, and is disposed within the outsole of the snowboard boot 10. The interface adjustment mechanism 100 also includes a plurality of interface adjustment assemblies 160. Each interface adjustment assembly 160 includes a base member 170 having a threaded aperture and an adjustment member or spacer 172 having a threaded portion threadably engageable with the threaded aperture of the base member so that the spacer 172 can be adjustable relative to the base member 170. When incorporated into the snowboard boot 10, the interface adjustment mechanism 100 provides the rider with an adjustable spacer/dampening system that can eliminate slop and provide dampening and shock absorption between the snowboard boot 10 and the snowboard binding 30. Eliminating slop and providing dampening and shock absorption provides the rider with improved control, force transmission, and feel.

22 Claims, 6 Drawing Sheets

ATHLETIC BOOT WITH INTERFACE ADJUSTMENT MECHANISM

FIELD OF THE INVENTION

The present invention relates generally to a binding/boot interface between a rider and a glide board, and more particularly to a snowboard boot that incorporates an adjustment mechanism.

BACKGROUND OF THE INVENTION

A snowboarder's boots are typically secured to the snowboard by a binding that has one of a variety of overall configurations depending on intended use and rider preferences. Some riders utilize a conventional binding that includes a rear strap that secures over the rider's instep and a forward strap that secures over the ball or toes of the rider's boot. Other riders utilize a step-in binding system, in which engagement members generally referred to as cleats are secured on the boot, typically on a lower or side surface of the sole, to selectively engage with jaws or catches on the binding. Numerous variations on these arrangements exist, but in each case the snowboard binding includes a frame or base plate that is fastened to the upper surface of the snowboard. Typically, screws are utilized that pass through apertures formed in either the snowboard base plate or in a disc that mounts in the center of the base plate to permit rotatable adjustment of the base plate positioning. The screws are threaded into inserts that are molded, adhered or otherwise affixed within the upper surface of the snowboard.

In designing snowboard inserts, several considerations are typically made. The binding should permit the snowboarder's boot to be as close as possible to contact with the snowboard, for good control, force transmission and feel. The boot should rest firmly against the binding base plate, without excessive slop that permits the boot to pivot forward and aft relative to the snowboard, again for better control. A predetermined degree of medial and lateral pivoting of the boot relative to the base plate may be permitted, particularly for certain riding styles. Finally, it is often desirable to provide for a degree of vibration dampening and shock absorption between the riders boots and the binding and board. Vibration dampening provides for better control, particularly when riding hard packed surfaces, and shock absorption is particularly beneficial for riding over jumps, half pipes, and other terrain.

In view of these needs, some binding manufacturers have developed bindings that accommodate gasket like elastomeric dampeners disposed between the binding plate and board, to absorb shock and vibration between the binding plate and board. Other manufacturers provide elastomeric dampener pads that mount on an upper surface of the binding plate, to absorb shock and vibration between the base plate and outsole of the boot. In some instances, dampener pads are provided that are inserted from below the base plate, through apertures defined in the base plate, before mounting the base plate on the board. The dampener pads project through the apertures a predetermined degree above the upper surface of the base plate.

In such dampened bindings, different thickness pads may be selectively removed and inserted, to change the height of the dampener pad projecting above the base plate, allowing for adjustment of the degree of dampening and to provide a variety of snowboard boot configurations with a better fit (eliminate excess slop). However, adjustment requires providing a variety of dampening pads, can only be made by first removing the base plate from the snowboard, and is limited to incremental adjustment as permitted by available dampener pad thicknesses. While adjustment may be made before a rider starts riding, adjustment during a ride may be impracticable due to lack of access to tools, difficulties in handling tools and components while on a snow covered slope, and the need to carry alternate dampener pads. Thus if a rider determines during a ride that excess slop exists between the boot outsole and binding, or a different degree of dampening is called for, adjustments typically can not or are not made.

Therefore, there is a need to create a mechanism that eliminates excess slop and provides dampening between the snowboard boot and the binding to overcome the deficiencies in the prior art.

SUMMARY OF THE INVENTION

In accordance with the present invention, an interface adjustment mechanism is provided for use in a snowboard boot to overcome the deficiencies of the prior art. More specifically, an interface adjustment mechanism is provided within the outsole of a snowboard boot to provide the rider with an adjustable spacer/dampening system that can eliminate slop and provide dampening and shock absorption between the snowboard boot 10 and the snowboard binding 30. Eliminating slop and providing dampening and shock absorption provides the rider with improved control, force transmission, and feel.

In accordance to an aspect of the present invention, an interface adjustment mechanism is provided for adjusting the interface between a boot and a binding comprising a frame member and fore and aft holding members coupled to the frame member. At least one adjustable member is adjustably mounted on either of the holding members. The adjustable member is extendable in a selected amount away from the frame member for adjusting the boot/binding interface.

In accordance to another aspect of the present invention, a snowboard boot selectively mountable to a binding is provided. The snowboard boot includes an upper fixedly secured to an outsole with the outsole having a bottom surface. The snowboard boot also includes an interface adjustment mechanism for adjusting the interface between the snowboard and the binding. The interface adjustment mechanism is disposed within the outsole and has at least one adjustment member. The adjustment member is extendable in a selected amount away from the bottom surface of the outsole.

In accordance to yet another aspect of the present invention, an athletic boot in combination with a binding to which the boot may be selectively coupled in a fixed disposition is provided. The combination comprising a binding having a boot interface surface, a boot having an outsole, and at least one interface adjustment member selectively securable to the outsole of the boot and having a binding interface surface that contacts the boot interface surface of the binding when the boot is coupled to the binding. The interface adjustment member is extendable in a selected amount away from the outsole of the boot.

In accordance to still yet another aspect of the present invention, an athletic boot in combination with a binding to which the boot may be selectively coupled in a fixed disposition is provided. The combination comprising a binding having a boot interface surface, a boot having an outsole, and a plurality of interface adjustment members selectively securable to the outsole of the boot, each adjustment member having a binding contact portion and a binding interface surface. The contact portion defines a thickness wherein the plurality of interface adjustment members are configured to having different predetermined contact portion thicknesses. The plurality of interface adjustment members are interchangeable to selectively adjust the degree of extension of the interface surface away from the outsole of the boot.

Thus, the present invention provides an interface adjustment mechanism that is incorporated into a snowboard boot to enable the rider to selectively adjust the height or disposition of the spacers without the necessity of removing or loosening the binding from the snowboard. The spacers can include a dampening head or engagement portion if dampening is desired. When securing the rider's snowboard boot to the snowboard binding prior to use, if it is determined that a spacer is not suitably contacting the base plate of the binding, or it is not sufficiently bearing against the dampener pads that are mounted to the binding, a spacer or multiple spacers can be readily adjusted. The user needs simple to twist the spacer within the base member by utilizing a tool such as a screwdriver or spanner wrench. When riding the snowboard, such as down a slope, it may be determined that there is excess slop in the binding, resulting in excessive movement of the boot relative to the board or insufficient shock and vibration dampening. When this occurs, adjustment of the binding can be made readily, including on the slope, again without the need to remove the binding from the board.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

Figure 1:
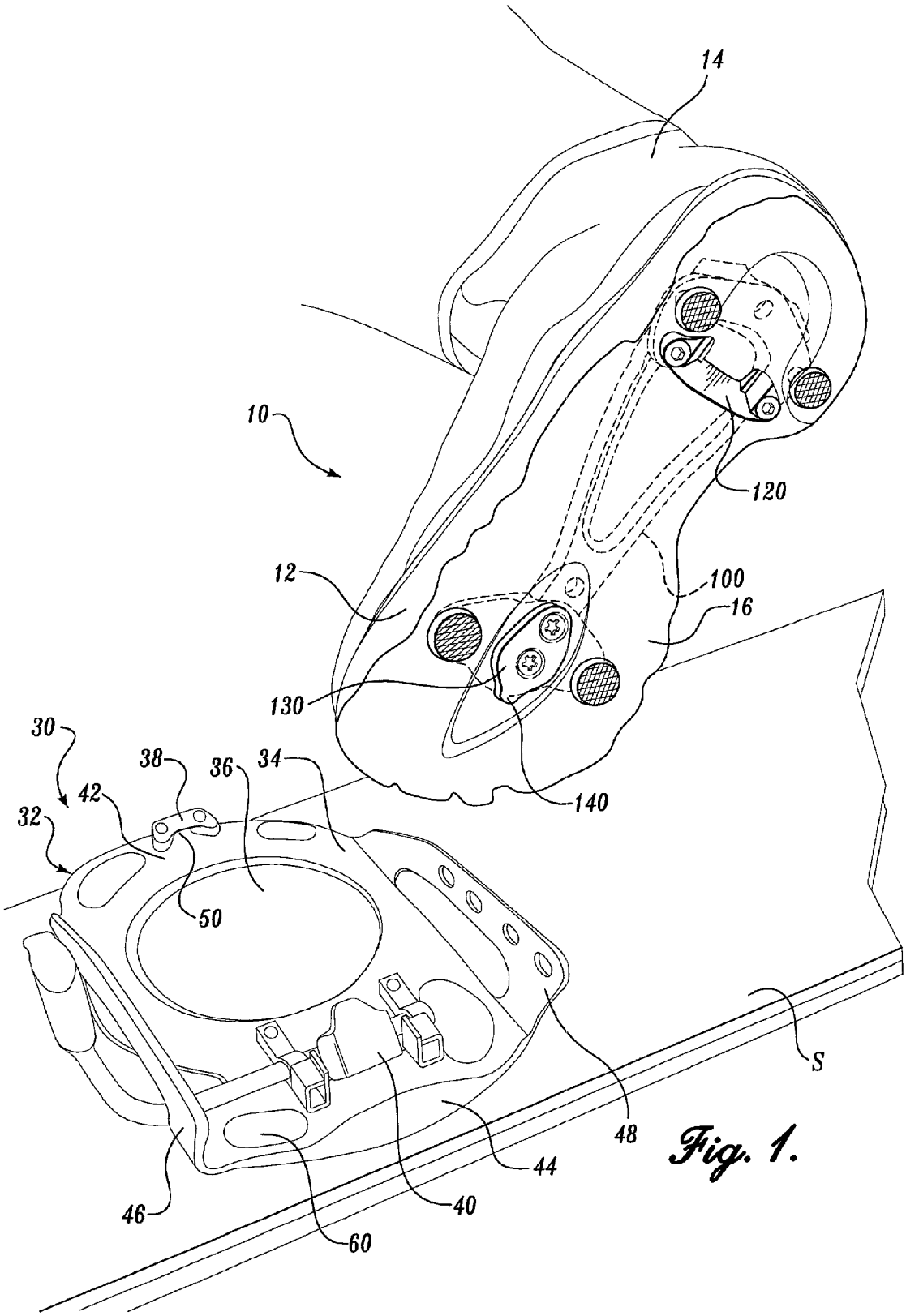
FIG. 1 illustrates a perspective view of a snowboard boot incorporating an interface adjustment mechanism constructed in accordance with aspects of the present invention above a step-in binding on a board.

Prior to describing an exemplary embodiment of the interface adjustment mechanism, a brief discussion of the configuration of one type of snowboard boot suitable for incorporating the present invention is set forth. Additionally, one type of snowboard binding to which the snowboard boot can mount will also be described. In this regard, attention is directed to FIG. 1, which illustrate selected components of a snowboard boot 10 and binding 30. Referring to FIG. 1, the snowboard boot 10 is of conventional construction, with the exception of the interface adjustment mechanism 100 which will be described in detail below with reference to FIGS. 2–4. The snowboard boot 10 includes an outsole 12 and an upper 14. The upper 14 is fixedly secured to the outsole 12. The outsole 12 is preferably constructed from a soft, flexible material so as to provide comfort and walkability. In the embodiment shown, the outsole includes a tread 16 and fore and aft cleats 130,120 mounted to the outsole 12 to be engaged with cleat retaining mechanisms 38 and 40 secured to the step-in binding 30. Other desirable boot components, such as toecaps, heel supports, and highbacks, are not shown for ease of illustration, but are well know to those familiar with snowboard boots.

As shown in FIG. 1, the snowboard boot 10 is shown selectively mountable to a conventional step-in snowboard binding 30. As with conventional bindings, the binding 30 is mounted to a snowboard S through the use of binding inserts (not shown). The binding inserts are molded, adhered, or otherwise mounted within the upper surface of the snowboard S, in a standard pattern which enables longitudinal and rotational adjustment of the snowboard binding 30. The snowboard binding 30 includes a baseplate 32, that is secured to the board through the use of a rotodisc (not shown). The baseplate 32 is the main structural body or frame of the binding 30, and is selectively secured in a desired rotational position on the board through operation of the rotodisc. The rotodisc suitably includes a plurality of slots that extend parallel to each other, and in a predetermined configuration that matches the pattern of inserts on the snowboard.

The baseplate 32 includes a platform 34, a rotodisc opening 36, and fore and aft cleat retaining mechanisms 38, 40. The platform 34 extends as a base portion of baseplate 32, and is disposed generally in a plane parallel to the upper surface of the snowboard S. The platform 34 extends beneath portions of the outsole 12 of the snowboard boot 10. In the illustrated embodiment, the platform 32 is generally rectangular in shape with a circular cutout forming the rotodisc opening 36 in the approximate center thereof. Thus, the platform 32 defines a toe end 42 and heel end 44 on either side of the rotodisc opening 36. The rotodisc opening 36 includes a plurality of teeth (not shown) that extend around the rotodisc opening 36 on the platform 34. The teeth are conventional in arrangement, and are adapted to secure the conventional rotodisc, so that the rotodisc may be loosened and the baseplate may be rotatably adjusted. The baseplate may include lateral and medial sidewalls 46 and 48 which extend upwardly along the sides of the platform 34 to form a rail along the lateral and medial side, respectively, of the snowboard boot 10 to hold the boot in position. In the embodiment shown, the sidewalls 46 and 48 extend generally perpendicular to the platform 34, with the toe ends of the sidewalls 46 and 48 being approximately uniform in height relative to each other and increasing in height toward the heel end of the platform 34.

Still referring to FIG. 1, the baseplate 32 also includes fore and aft cleat retaining mechanisms 38, 40. The fore cleat retaining mechanism 38 is generally a c-shaped bracket and is secured to the approximate center of the toe end 42 of platform 34 to define a recess 50. The recess 50 is dimension to receive a protrusion portion 140 of the fore cleat 130. The aft cleat retaining mechanism 40 includes a pivoting jaw portion that is pivotally coupled to the approximate center of the heel end of platform 34. The jaw portion pivotally displaces when first engaging the aft cleat 120. After pivotally displacing to allow the aft cleat 120 to pass by, the jaw portion returns to its non-engagement position to selectively retain the aft cleat 120.

The baseplate 32 further includes elastomeric portions 60 that are inserted from below the base plate 32, through apertures defined in the base plate 32, before mounting the base plate 32 on the board S. The elastomeric portions 60 project through the apertures a predetermined degree above the upper surface of the base plate 32. In the embodiment shown, the elastomeric portions 60 are disposed at the fore and aft corners of the platform 34.

Figure 2:
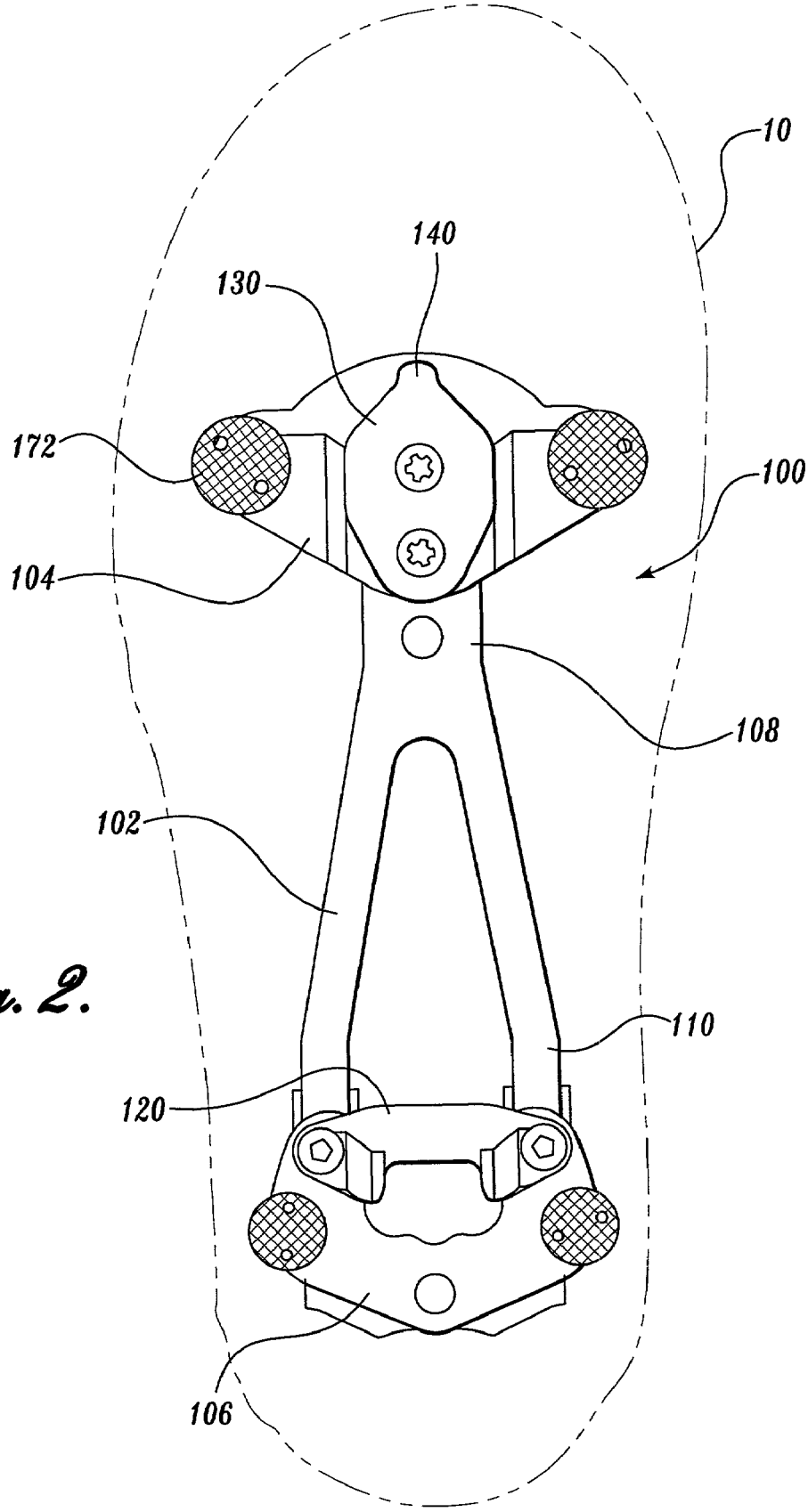
FIG. 2 illustrates a bottom view of a snowboard boot incorporating an interface adjustment mechanism constructed in accordance with aspects of the present invention.
Figure 3:
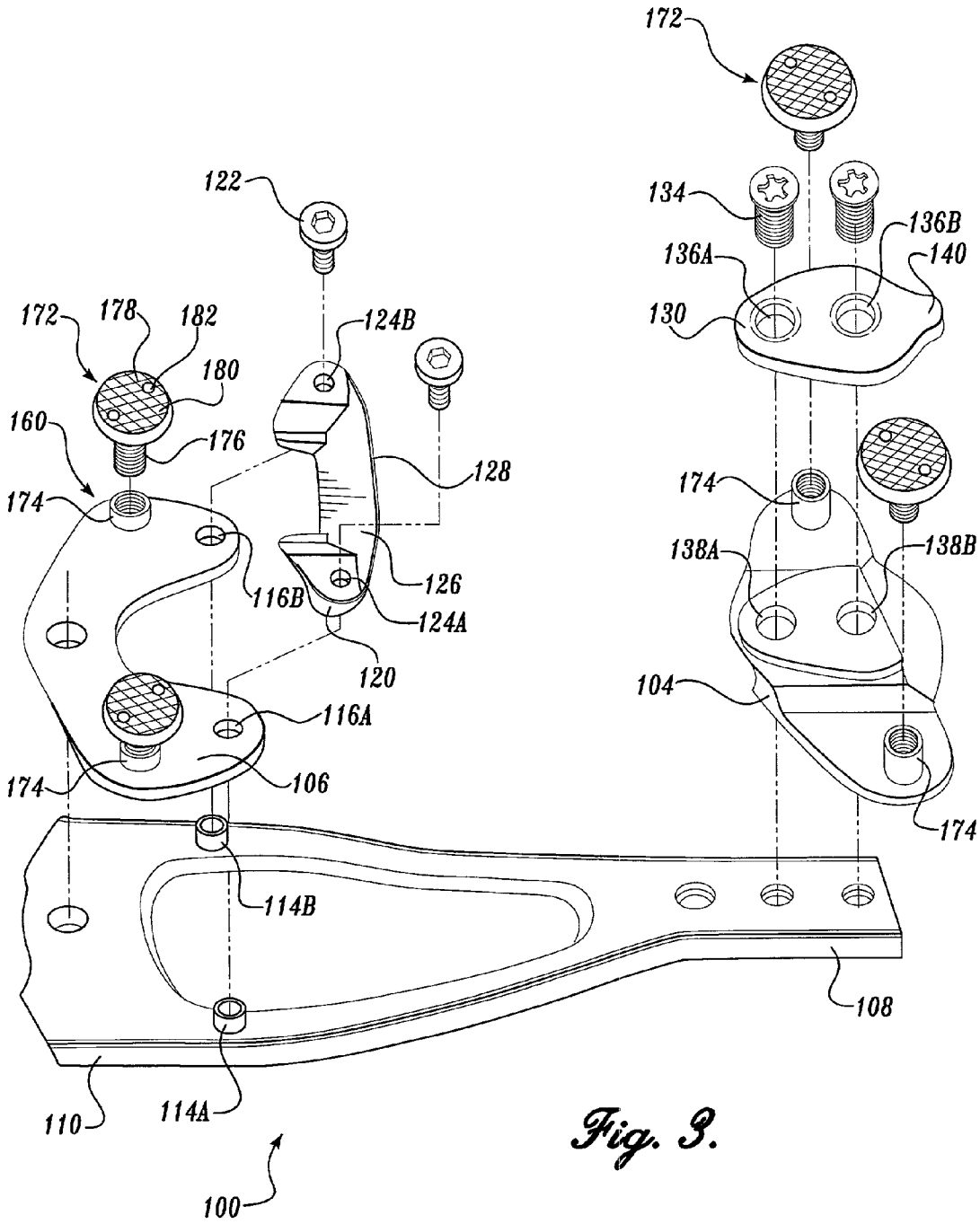
FIG. 3 illustrates an exploded assembly view of the of the interface adjustment mechanism shown in FIG. 2.
Figure 4:
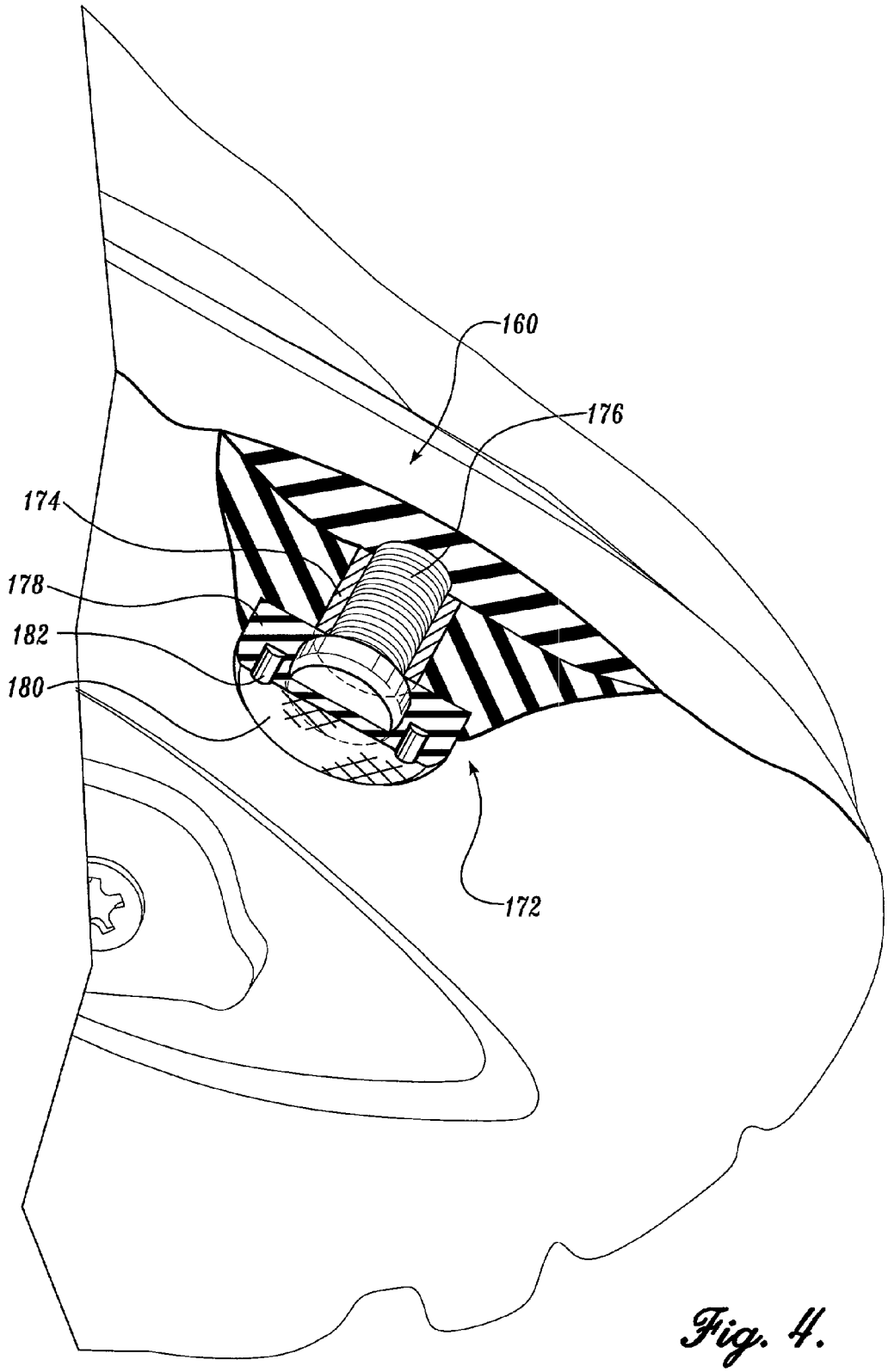
FIG. 4 illustrates a perspective cross-sectional view of a portion of the interface adjustment mechanism shown in FIG. 3 incorporated within a snowboard boot.

As previously noted, the present invention is directed to an interface adjustment mechanism incorporated within a snowboard boot of the type described above with reference to FIG. 1 for providing an improved interface between the snowboard boot and the binding. One suitable embodiment of the interface adjustment mechanism 100 formed in accordance with aspects of the present invention is illustrated in FIGS. 2–4 and comprises a plurality of interface adjustment assemblies 160 mounted to a frame member 102 through fore and aft adjustable spacer holding members 104, 106. When incorporated into the snowboard boot 10, the interface adjustment mechanism 100 provides the rider with an adjustable spacer/dampening system that can eliminate slop and provide dampening and shock absorption between the snowboard boot 10 and the snowboard binding. Eliminating slop and providing dampening and shock absorption provides the rider with improved control, force transmission, and feel.

Referring now to FIGS. 2–4, the interface adjustment mechanism 100 includes a frame member 102, and fore and aft adjustment holding members 104, 106 and is preferably molded into the outsole of the snowboard boot 10. The frame member 102 is preferably constructed of a rigid material such as steel and includes a toe end 108 and a heel end 110. The fore and aft adjustment holding members 104, 106 are secured to the toe end 108 and the heel end 110, respectively, by suitable fasteners such as screws or the like. In the embodiment shown, the heel end 110 of the frame member 102 has two spaced-apart threaded bosses 114A, 114B which protrude orthogonally upward from the frame member 102 in the direction of the binding. The aft holding member 106 is generally plate-like and includes two spaced-apart apertures 116A, 116B which correspond in dimension and distance apart to the bosses 114A, 114B so that the adjustment member 106 can be placed onto the frame member 102 with the bosses 114A, 114B extending up through the apertures 116A, 116B to provide connection therebetween. The term "up" is used in reference to the positioning of the interface adjustment mechanism 100 as shown in FIG. 3 and it is to be understood that in use this mechanism is flipped upside-down An aft cleat 120 is removably secured to the threaded bosses 114A, 114B of the frame member 102 by threaded fasteners 122 or the like. The cleat 120 is bar-shaped and includes apertures 124A, 124B for receiving the threaded fasteners 122. The apertures 124A, 124B can be countersunk so that the threaded fasteners lie flush with the top surface of the cleat 120. The top surface 126 of the elongate portion 128 of cleat 120 generally tapers downwardly as it extends toward the heel end 110 of the frame member 102. When secured to bosses 114A, 114B, the cleat 120 lies substantially perpendicular to the major axis of the frame member 102.

A fore cleat 130, generally elliptical in shape, is secured to the frame member 102 through apertures in the frame member 102 by fasteners 134 such as screws. The cleat 130 includes apertures 136A, 136B for receiving the threaded fasteners 134 and can be countersunk so that the threaded fasteners 134 lie flush with the top surface of the cleat 130. In the embodiment shown, the fore adjustment holding member 104 is generally plate-like and includes two spaced-apart apertures 138A, 138B which correspond in dimension and distance apart with the apertures 136A, 136B within the cleat 130 and the apertures within frame member 102 so that the adjustment holding member 104 can be secured between the cleat 130 and the frame member 102. The cleat 130 also includes a projecting portion 140 that projects in the direction of the toe end 108 of the frame member 102. The projecting portion 440 is suitably dimensioned to be received within the recess 50 of the cleat retaining mechanism 38 (FIG. 1). Numerous other binding elements known in the art can be utilized in place of the cleats 128, 130, which are illustrated and described for exemplary purposes only. Thus, binding rods, cam latches and other known binding elements, mounted fore and aft or on lateral and medial sides of the boot may be suitably used in place of the cleats.

The interface adjustment mechanism 100 also includes a plurality of interface adjustment assemblies 160 as shown in FIG. 3. In order to accommodate these, the outsole of the boot includes a plurality of receiver apertures 162 (FIG. 4) extending therein. Each receiver aperture 162 extends partially through the outsole 12. In the embodiment illustrated, the receiver apertures 162 are generally circular in shape. However, the shape of the receiver apertures 162 may be otherwise configured to correspond to the shape of the interface adjustment assemblies, as shall be described subsequently herein.

In the embodiment illustrated, there are four interface adjustment assemblies 160, disposed at the fore and aft corners of the outsole 12. Referring to FIG. 1, the four interface adjustment assemblies 160 are aligned with and contact the four elastomeric portions 60 mounted to the base plate of binding 30. The elastomeric portions 60, which in the illustrated embodiment are dampener pads, cooperate with the interface adjustment assemblies 160 to form an interface adjustment and dampening system. While the interface adjustment assemblies 160 are beneficially coupled with the elastomeric portions 60, this is not required, and the interface adjustment assemblies 160 may instead contact rigid portions of the binding or snowboard upper surface.

Referring back to FIG. 3, each interface adjustment assembly 160 includes a base member and an adjustment member or spacer. In the embodiment shown, the base member is an internally threaded collar 174 integrally secured to the fore and aft corners of the holding members 104, 106. The collar 174 projects orthogonally away from the holding members and through the aperture 162; thus, projecting vertically through the outsole. The spacers 172 include an engagement portion 178 that is adhered, such as by overmolding, onto the head of a threaded fastener 176. To assemble the assembly 160, the fastener 176, on which the spacer 172 is mounted, is threaded into the threaded collar 174. The vertical position of the spacer 172 is selectively adjusted, so that it extends a predetermined desired degree in height below the bottom surface of the outsole of boot, i.e., in the vertical direction defined orthogonal to the outsole of boot (and orthogonal to the frame member).

The spacers 172 are generally cylindrical in shape and are suitably formed from a polymeric material. Alternatively, the spacers can be formed from an elastomeric material that is capable of absorbing shock and vibration, as well as eliminating slop between the boot and binding. The durometer hardness of the spacers 172 may be selected for a desired degree of dampening. Multiple spacers 172 of differing durometer hardness may be provided in a kit, so that a user may completely replace one spacer 172 with an alternate spacer for either a greater degree of dampening, lesser degree of dampening, or to provide a greater total height.

An engagement surface 180 of the engagement portions 178 of spacers 172 may be suitably contoured or textured so as to provide for frictional contact between the spacers 172 and the elastomeric portions 60 of binding 30. For example, a plurality of raised ridges is formed on the upper surface of the spacer to provide good traction. As shown in FIGS. 2 and 3, apertures 182 are formed in the engagement portions 178 of spacers 172 for adjustment using a driver tool. This adjustment can be made readily prior to use, or during use, without any need to remove or loosen the binding 30 from the snowboard S. Multiple spacers can be adjusted to differing heights, so that the contact or space and the degree of dampening provided by the various spacers 172 included in the assemblies 160 can vary about different locations of the board to custom fit a boot to the binding and the performance requirements of the individual user.

In the illustrated embodiment, the adjustment members 160 are mounted on a frame 102 incorporated internally into the sole of the boot. Other mounting bases may be provided for the adjustment members 160. For example, they may be secured to a rigid plate base built into the sole of the boot, or may be carried in a binding element that is secured externally to the outsole, such as on a bale rod binding assembly. Further, the location and number of adjustment members 160 may vary, such as including only one or two adjustment members on the toe end or on the heel end of the boot or using three spaced adjustment members.

Figure 7:
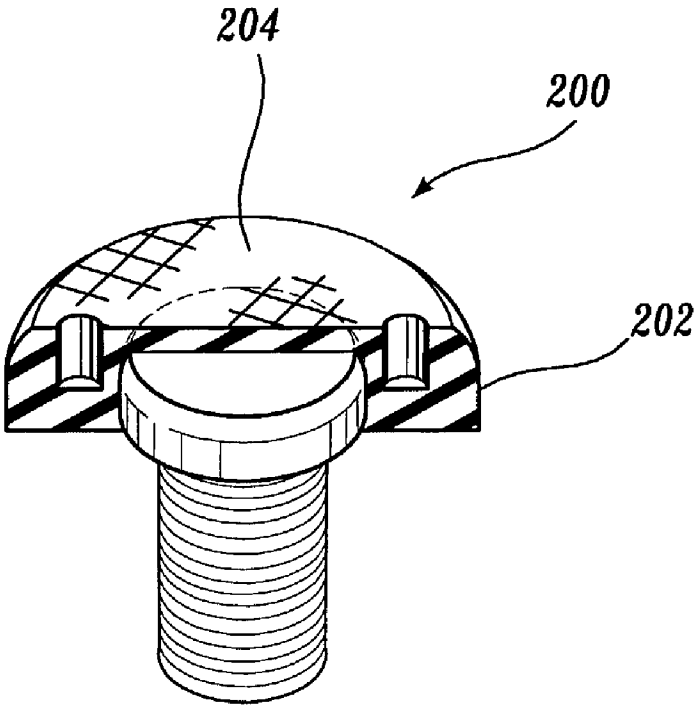
FIG. 7 illustrates a perspective view of the interface adjustment member shown in FIG. 6 having a different contact portion thickness.
Figure 6:
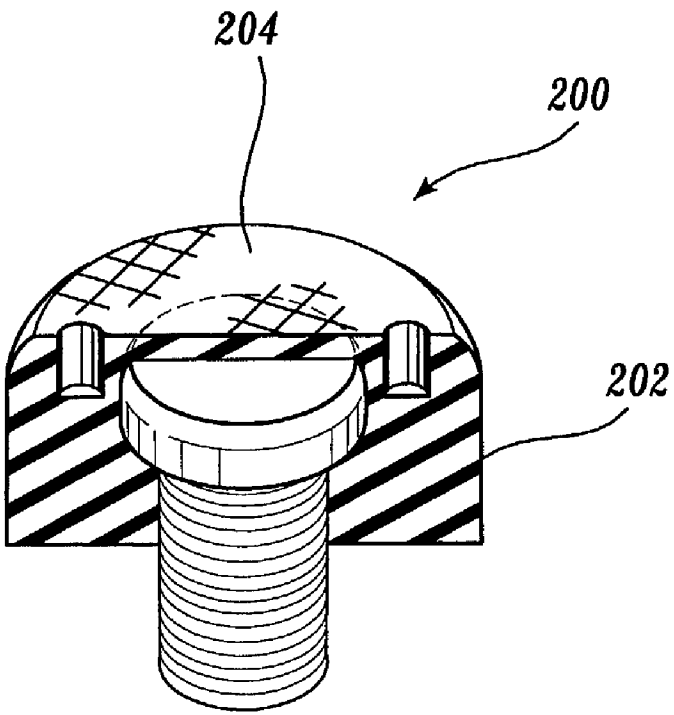
FIG. 6 illustrates a perspective view of an interface adjustment member utilized in an alternative embodiment of the present invention.

In an alternative embodiment of the present invention, the snowboard boot describe above includes a plurality of interface adjustment members 200 having a binding contact portion 202, as shown in FIGS. 6 and 7. The binding contact portions 202 of the plurality of interface adjustment members 200 have different predetermined thicknesses and include a binding interface surface 204. The plurality of interface adjustment members 200 are interchangable to selectively adjust the degree of extension of the interface surface 204 away from said outsole of the boot. Before or during use, multiple interface adjustment members 200 having differing heights or thicknesses can be swapped or interchanged by the rider so that the contact or space and the degree of dampening provided by the various interface adjustment members 200 can vary about different locations of the board to custom fit a boot to the binding and the performance requirements of the individual user. In this embodiment, the interface adjustment members 200 are to be completed threaded into the outsole of the boot. However, like the first embodiment described above, the interface adjustment members 200 can be adjustable secured by not completely screwing the interface adjustment members to the outsole of the boot. Additionally, as described above with respect to the first embodiment, the interface adjustment members 200 can be secured to a variety of different base like members mounted within the outsole such as a frame member, a collar member, or a threaded aperture.

Figure 5:
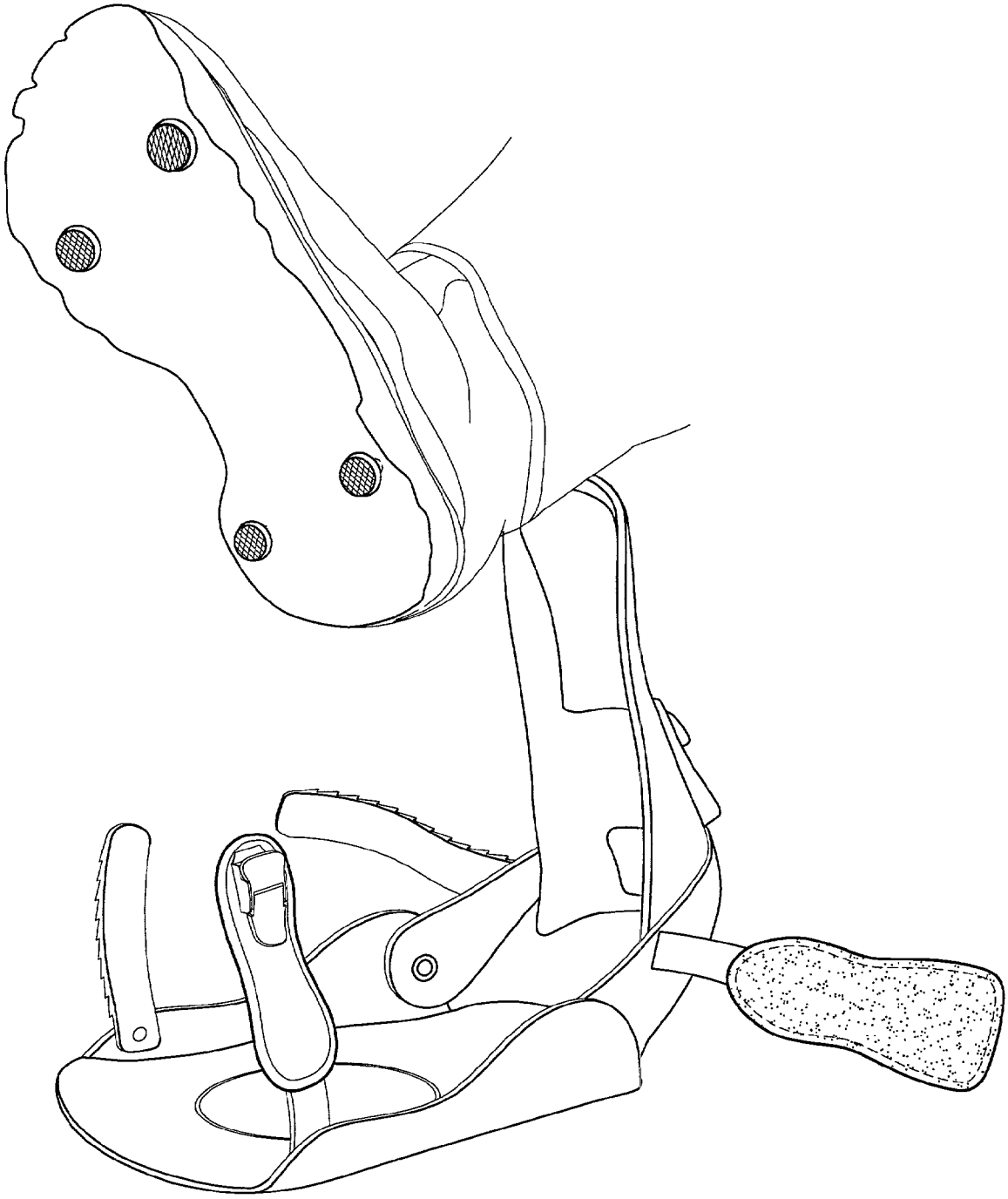
FIG. 5 illustrates a perspective view of a securing strap type snowboard binding and boot incorporating an interface adjustment mechanism constructed in accordance with aspects of the present invention.

While the preferred embodiment of the interface adjustment mechanism described above and illustrated herein have been shown used on conventional step-in snowboard bindings, it should be readily evident that the invention is equally applicable for use on other types of bindings, such as boot securing strap type bindings shown in FIG. 5. To this end, the snowboard boot used in a boot securing strap type binding does not require the presence of cleats 120, 130. Likewise, the binding uses straps to hold the shoe to the binding instead of cleat retaining mechanisms 38, 40. One suitable but non-limiting example of a boot securement strap type binding with which the present invention may be used is the strap binding sold by K-2 Corporation, Vashon Island, Wash.

Likewise, while the interface adjustment mechanism described above and illustrated herein have been shown used within snowboard boots, it should be readily evident that the interface adjustment mechanism of the present invention is equally applicable for use with other types of athletic shoes, such as ski boots and bicycle shoes.

The present invention has been described thus far with reference to elastomeric spacers or dampeners. Other types of adjustable dampeners, including dampeners with integrated springs or hydraulic fluid dampening may alternately be used.

The present invention has been described and illustrated with respect to vertical adjustment of the spacers. Adjustment in other orientations is also within the scope of the present invention. For example, by arranging the adjustment assemblies to move along a horizontal axis, spacer position in the forward and aft, or lateral and medial, directions may be provided in accordance with the present invention.

The adjustment assemblies described and illustrated above utilize screw threads. Other types of adjustments may be utilized. For example, a spring biased ratchet mechanism, rotatable to a first position for longitudinal adjustment opposed by spring force, and routable to a second position to engage in a ratchet detent, may be employed. As a further example, other rotary to linear adjustment mechanisms may be used in place of a threaded adjustment, such as a cam and spiral contoured follower may be incorporated, as permitted by space constraints. Additionally, the interface adjustment members may be coupled to the base member or frame member by means other than threaded means such as sliding slots or snap fitted.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. An outsole of an athletic boot comprising:

an outsole body having a toe region and a heel region;

a frame member secured to said outsole body;

a pair of adjustment members adjustably mounted on said frame member at either said toe region or said heel region of said outsole body, a portion of each adjustment member being adapted for engagement with a binding, said adjustment members being extendable in a selected amount away from said frame member; and fore and aft cleats, said fore and aft cleats removably coupled to said frame member;

wherein each of said adjustment members further includes an engagement portion and a threaded portion, wherein said engagement portion is made from an elastomeric material.

2. The outsole of claim 1, wherein said engagement portion has an engagement surface, said engagement surface including apertures that are engageable with a driver tool for rotary adjustment.

3. The outsole of claim 1, wherein said adjustment members are extendable.

4. An outsole of an athletic boot selectively mountable to a binding comprising:

a frame member disposed within said outsole and having first and second ends;

first and second spacer holding members removably coupled to said first and second ends of said frame member, respectively;

at least one base member coupled to either of said first and second spacer holding members;

at least one spacer having a binding contact surface adapted to contact the binding, said spacer adjustably mounted to said base member for selective orthogonal adjustment relative to said frame member; and at least one binding attachment member coupled to said outsole.

5. An athletic boot selectively mountable to a binding comprising:

an upper fixedly secured to an outsole;

an interface adjustment mechanism for adjusting the interface between said boot and the binding, said interface adjustment mechanism disposed within said outsole and comprising a plurality of adjustment members and a plurality of base members, one of said plurality of adjustment members adjustably coupled to each base member, said adjustment members being extendable in a selected amount away from said outsole; and at least one binding attachment member coupled to said outsole.

6. The boot of claim 5, said outsole having a bottom surface, and said adjustment members being extendable in a selected amount away from said bottom surface of said outsole.

7. The boot of claim 5, wherein said interface adjustment mechanism further includes a base member, said adjustment members adjustably coupled to said base member.

8. The boot of claim 7, wherein each of said adjustment members further includes an engagement portion and a threaded portion.

9. The boot of claim 8, wherein said interface adjustment mechanism further includes a frame member, each of said base members coupled to said frame member and having a plurality of threaded apertures, said threaded portion of each of said adjustment members threadably engaged with one of said plurality of threaded apertures of said base member.

10. The boot of claim 9, further comprising fore and aft cleats, said fore and aft cleats removably coupled to said frame member.

11. The boot of claim 8, wherein said engagement portion has an engagement surface, said engagement surface including apertures that are engageable with a driver tool for rotary adjustment.

12. A snowboard boot having toe and heel ends, said boot selectively mountable to a binding, comprising:

an outsole having a bottom surface;

an elongated frame disposed within said outsole, said frame extending between about said toe end and about said heel end of said boot;

at least one base member mounted to said frame;

fore and aft cleats, said fore and aft cleats removably coupled to said frame; and at least one adjustment member adjustably mounted on said base member for selective substantially orthogonal adjustment relative to said outsole.

13. The snowboard boot of claim 12, wherein said base member defines a first threaded surface, and said adjustment member includes an engagement portion adapted for engagement with the binding and a second threaded surface threadably engageable with said first threaded surface of said base member.

14. The snowboard boot of claim 12, wherein said adjustment member is adjustably mounted on said base member for selective substantially orthogonal adjustment relative to said bottom surface of said outsole.

15. The snowboard boot of claim 12, wherein said outsole defines at least one adjustment member mounting aperture opening to said bottom surface, said base member mounted within said adjustment member mounting aperture.

16. The snowboard boot of claim 12, further comprising a plurality of adjustment members and a plurality of base members, one of said plurality of adjustment members adjustably coupled to each base member.

17. A snowboard boot selectively mountable to a binding comprising:

an outsole having a bottom surface;

a frame member coupled to said outsole and having first and second ends;

first and second spacer holding members coupled to said first and second ends of said frame member, respectively; and at least one interface adjustment assembly associated with either of said first and second spacer holding members, said interface adjustment assembly including a base member fixedly secured to either of said first and second spacer holding members and having a threaded aperture, and a spacer having an engagement portion and a threaded portion threadably engaged with said threaded aperture of said base member, said spacer being threadably adjustable relative to said base member so that said engagement portion of said spacer projects a selective amount away from said outsole.

18. The snowboard boot of claim 17, wherein said engagement portion of said spacer is made from an elastomeric material.

19. The snowboard boot of claim 17, wherein said base member of said interface adjustment assembly is directly coupled to either of said first and second spacer holding members.

20. The snowboard boot of claim 17, further comprising first and second cleats, said first and second cleats removably coupled to said first and second ends of said frame member, respectively.

21. The snowboard boot of claim 17, said spacer being threadably adjustable relative to said base member so that said engagement portion of said spacer projects a selective amount away from said bottom surface of said outsole.

22. An athletic boot in combination with a binding to which the boot may be selectively coupled in a fixed disposition, comprising:

a binding having a boot interface surface;

a boot having an outsole; and a plurality of interface adjustment members selectively securable to said outsole of said boot, each interface adjustment member having a binding contact portion and a binding interface surface that contacts the boot interface surface of said binding when said boot is coupled to said binding, said contact portion defining a thickness;

wherein said plurality of interface adjustment members are configured to having different predetermined contact portion thicknesses, said plurality of interface adjustment members being interchangeable to selectively adjust the degree of extension of said interface surface away from said outsole of said boot.

* * * * *